US007973478B2

(12) United States Patent
Kotowicz

(10) Patent No.: US 7,973,478 B2
(45) Date of Patent: Jul. 5, 2011

(54) ELECTRODE ROD HOLDER IN A HIGH-PRESSURE DISCHARGE LAMP

(75) Inventor: Adam Kotowicz, Berlin (DE)

(73) Assignee: OSRAM Gesellschaft mit beschränkter Haftung, München (DE)

( * ) Notice: Subject to any disclaimer, the term of this patent is extended or adjusted under 35 U.S.C. 154(b) by 0 days.

(21) Appl. No.: 12/734,458

(22) PCT Filed: Nov. 29, 2007

(86) PCT No.: PCT/EP2007/063024

§ 371 (c)(1),
(2), (4) Date: May 3, 2010

(87) PCT Pub. No.: WO2009/068104

PCT Pub. Date: Jun. 4, 2009

(65) Prior Publication Data

US 2010/0253206 A1 Oct. 7, 2010

(51) Int. Cl.
*H01J 17/18* (2006.01)

(52) U.S. Cl. ..... 313/623; 313/625

(58) Field of Classification Search ..... 313/623–626
See application file for complete search history.

(56) References Cited

U.S. PATENT DOCUMENTS

| | | | | |
|---|---|---|---|---|
| 4,038,578 | A | 7/1977 | Mathijssen | |
| 4,197,957 | A * | 4/1980 | Buhrer | 220/2.1 R |
| 5,369,329 | A | 11/1994 | Austad et al. | |
| 5,552,670 | A * | 9/1996 | Heider et al. | 313/625 |
| 5,663,607 | A | 9/1997 | Kira et al. | |

FOREIGN PATENT DOCUMENTS

| | | |
|---|---|---|
| DE | 26 23 099 A-1 | 12/1976 |
| DE | 26 23 099 C2 | 12/1976 |
| DE | 200 05 534 U1 | 6/2000 |
| JP | 2003 323866 A | 11/2003 |

* cited by examiner

*Primary Examiner* — Vip Patel
(74) *Attorney, Agent, or Firm* — Holtz, Holtz, Goodman & Chick, PC

(57) ABSTRACT

The invention relates to an improved electrode rod (1) holder with the aid of a metal tube piece 5 and a metal plate 6 connected in a fixed manner to the metal tube piece for a mercury ultra-high pressure discharge lamp.

16 Claims, 1 Drawing Sheet

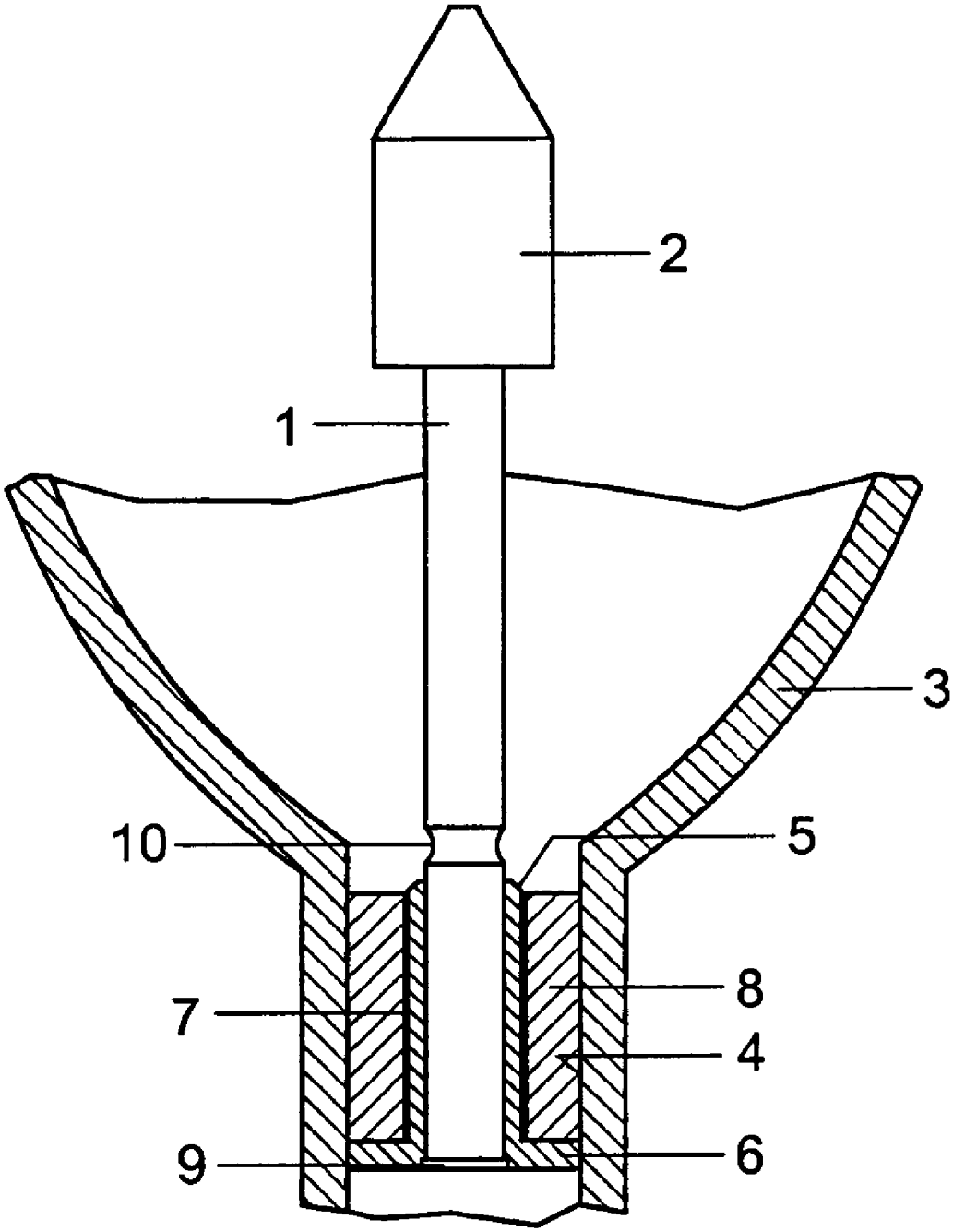
2
1
3
10
5
8
7
4
9
6

ELECTRODE ROD HOLDER IN A HIGH-PRESSURE DISCHARGE LAMP

This application is a U.S. National Phase Application under 35 USC 371 of International Application PCT/EP2007/063024, filed Nov. 29, 2007, which is incorporated herein in its entirety by this reference.

TECHNICAL FIELD

This invention relates to high-pressure discharge lamps and specifically to the problem of fastening an electrode rod.

PRIOR ART

High-pressure discharge lamps contain electrode rods in a discharge vessel, generally made from quartz glass, a discharge for light generation being started and maintained between said electrode rods. Often, the electrode rods have thicker electrode heads. Such lamps are used not only for generating visible light, but for example also as UV emitters, which is also intended to be included below under the term "lamp".

The electrode rods are held in discharge vessel end regions, which are generally referred to as "lamp stem" and contact is made with said electrode rods there. Among the many technical criteria involved in the design and production of high-pressure discharge lamps, until now stability and reliability of the mechanical holding arrangement for an electrode rod in the lamp stem has not played a significant role.

DESCRIPTION OF THE INVENTION

The present invention is based on the object of specifying a high-pressure discharge lamp and an associated production method with an improved electrode rod holding arrangement.

The invention provides a high-pressure discharge lamp with an electrode rod, which is held in a glass vessel stem, characterized by a metal tube portion, in which an electrode rod part is held and which is held in the glass vessel stem, the metal tube portion being fixedly connected to a metallic transverse support, which protrudes beyond the metal tube portion transversely with respect to the direction of the electrode rod, and a corresponding production method.

Preferred configurations are specified in the dependent claims and, in precisely the same way as the description below with the various features, in principle relate to both categories of the invention, namely to the lamp as well as to the production method.

The basic concept of the invention consists in a metal tube portion for mounting the electrode rod along a certain axial length. In contrast to the flat (in the direction of the electrode rod axis) fastening plates, known from the prior art, the term "tube portion" is therefore understood to mean that the tube portion has a markedly smaller wall thickness (transversely with respect to the electrode rod axis) than axial length. The axial length can, but does not have to be, longer than the outer diameter.

In addition, a transverse support for the tube portion is provided, i.e. a component part which is fixedly connected to the tube portion and protrudes beyond said tube portion transversely with respect to the longitudinal axis of the electrode rod and which produces or assists the anchoring of the tube portion in the lamp stem. This transverse support therefore to a certain extend acts as an anchor and can correspondingly be designed in a wide variety of ways, for example as transverse rods with a cross or star shape or else as plates corresponding to the prior art.

Preferably, the tube portion is round in just the same way as the electrode rod, but other cross-sectional profiles are naturally also conceivable. Preferably, the cross-sectional profile of the tube portion is configured in such a way that the electrode rod fits in in such a way as to substantially conform. However, this is not absolutely necessary either. Mechanical fixing can also be achieved with different cross-sectional profiles, but this generally does not involve any advantages.

The mechanical support of the electrode rod along an axial extent is essential to the invention. That is to say that the inventors have established that the conventional joints between electrode rods and fastening plates can result in problems in terms of reliability as a result of the severe loading of the transition region between the two component parts.

As is already known from the conventional plate fastenings, electrical contact is preferably also made with the electrode rod via the fastening. The metal tube according to the invention is therefore preferably electrically connected and at least partially conducts the lamp current.

A particularly preferred joining technique is provided by the rod being pressed axially and cold into the tube portion. By dispensing with an external heating effect such as during soldering or welding, embrittlement of the metals involved, in particular of the electrode rod, or another type of weakening as a result of high temperatures can be avoided. With a corresponding fit, mechanically and electrically effective and permanent joints can be produced by virtue of the compression.

In this case, the electrically effective contact areas can be enlarged, but also dimensional tolerances which are relevant for the mechanical fit are compensated for by interposed foil portions. During the production, the tolerances can even be gauged individually and can be taken into consideration individually by virtue of foil portions being provided correspondingly in different numbers (or being omitted).

The use of a metal foil is also advantageous outside the tube portion, and not only therein. A foil can be placed or wound around the tube portion according to the invention in order to alleviate or eliminate any stress and friction problems in relation to the surrounding glass which may occur primarily as a result of different coefficients of thermal expansion.

A further improvement can be achieved with the invention by virtue of the fact that the electrode rod is tapered in the vicinity of the tube portion according to the invention, but outside said tube portion. In this case, the tapering is intended in any case to be arranged closer to the tube portion than to that end of the electrode rod which is on the discharge side. The tapering serves the purpose of localizing and concentrating bending movements in particular in the case of high-power lamps with heavy electrode rods and/or electrode heads or else in the case of electrode heads which are relatively solid in relation to the electrode rods and the stability thereof in smaller lamps and lamps of average size. By virtue of the arrangement outside the tube portion and therefore outside the holding arrangement for the electrode rod, there is less or no bending stress on the electrode rod part in the tube portion and in particular less mechanical stress on glass parts which surround the tube portion or in which said tube portion is held. Instead, the electrode rod bends in a free region, in which there is no stress on any brittle glass parts.

In turn, the tube portion is preferably held in a glass cylinder, which is arranged in the lamp bulb, as described above optionally with a metal foil interposed, the glass cylinder being supported on the lamp bulb. The above-mentioned plate shape of the transverse support for the tube portion is preferred. In this case, it is favorably provided at the end of the described glass cylinder and terminates said glass cylinder towards its end which is remote from the discharge, i.e. for its part is supported on the lamp bulb. The tube portion and the plate are in the process fixedly connected to one another, preferably produced from the same material and, for example, welded, soldered or preferably produced in one piece.

The lamp current can be supplied from the outside in a manner known per se via metal foils, in particular molybdenum foils. Said foils can in principle be connected to the electrode rod itself, but also to the tube portion according to the invention. Owing to the relatively large outer circumference of the plate, said foils are preferably attached thereto, with the result that the lamp current is passed from the foils, via the plate and the tube portion, to the electrode rod. Since the plate and the electrode rod can touch one another, part of the lamp current can naturally also flow past the tube portion.

A further improvement of the electrode rod holding arrangement can be achieved by the electrode rod being thickened at its end remote from the discharge. Thus, an axial shift in the tube portion in the direction towards the discharge can be avoided because the thickened portion can be supported on the tube portion and/or on the plate or another transverse support. In the case of axially effective forces of inertia as a result of vibrations during transport or else in use, this may be of importance, in particular in the case of electrode heads which are relatively large in relation to the electrode rod and/or high-power lamps with correspondingly heavy electrode rods and heads.

Preferred materials are tungsten and molybdenum for the electrode rod, the plate and the tube portion according to the invention, and tungsten for the electrode head itself. The abovementioned foils between the electrode rod and the tube portion according to the invention, if provided, are preferably made from tantalum, but can also be made from molybdenum or tungsten; the foils outside the tube portion and the foils for supplying power from the outside are made from molybdenum.

Particularly attractive possible applications for the invention, as already variously indicated, are in particularly high-power lamps. These are preferably mercury discharge lamps with operating pressures of 5 bar or more and/or powers of over 1 kW, 2 kW, 3 kW, 4 kW and 5 kW, in order of increasing preference.

BRIEF DESCRIPTION OF THE DRAWING

The invention will be explained below with reference to a preferred exemplary embodiment, wherein the individual features may also be essential to the invention in other combinations and relate both to the lamp and to the production method.

The FIGURE shows a schematic and partially sectional vertical plan view of part of an ultra-high-pressure discharge lamp according to the invention as the exemplary embodiment.

PREFERRED EMBODIMENT OF THE INVENTION

The FIGURE shows a vertical electrode rod 1 consisting of tungsten with an electrode head 2 which is configured to be relatively solid. The electrode rod 1 and the electrode head 2 together form the cathode of the lamp and have a total mass of the order of magnitude of 0.3 kg. The anode, which is not illustrated in the FIGURE apart from a relatively large electrode rod and an electrode head with a slightly deviating shape, but has a similar construction, has a total mass of the order of magnitude of 1 kg.

This lamp is an industrial UV lamp for semiconductor lithography or light exposure applications in LCD screen manufacture with a power of the order of magnitude of from 20 to 25 kW and a hollow lamp bulb 3 (only partially illustrated in the FIGURE) with the size approximately of a football.

The lamp bulb 3 merges with a hollow-cylindrical bulb stem 4, which actually reaches further downwards vertically than specified in the FIGURE. The lamp bulb 3 is therefore illustrated in full at the top and cut off at the bottom.

The electrode rod 1 is held in a molybdenum tube portion 5, which merges, in its region remote from the discharge, with a molybdenum plate 6, which is supported on the inner wall of the bulb stem 4. The tube portion 5 and the plate 6 are designed to be in one piece.

In this case, the electrode rod 1 has been pressed into the tube portion 5 in the axial direction prior to fitting of the electrode head 2, wherein an individual number of tantalum foil portions has been interposed depending on the dimensional tolerances in the individual case. These foil portions improve the mechanical fit and enlarge the electrical contact areas, but are not illustrated in any more detail in the FIGURE.

However, the FIGURE shows, by virtue of a slightly thicker line, molybdenum foil windings 7 radially outside the tube portion 5 according to the invention and between said tube portion 5 and a quartz glass cylinder 8 surrounding said tube portion 5.

The electrode rod 1 is thicker at its lower end, i.e. the end remote from the discharge, and is therefore supported in the axial direction on the plate 6 or on the tube portion 5, with the thickened portion being denoted by 9.

In addition, the FIGURE does not show that the molybdenum plate 6 is connected to molybdenum foil portions in the form of power supply lines in a manner known per se on its outer circumference, said molybdenum foil portions being passed outwards within the bulb stem 4 and outside a glass fill portion (likewise not shown) therein, and which form a gas-tight, but electrically conductive connection solution. The foil portions are spot-welded with relatively small weld spots of the order of magnitude of 0.5-1 mm in diameter. The spot-welding operations mean a negligible heat input and do not result in embrittlement. In principle, other welding processes would also be possible here, for example resistance welding.

Finally, the FIGURE shows a tapered portion 10 of the electrode rod 1 virtually directly above that end of the tube portion 5 which faces the discharge, said tapered portion acting as a bending point for transverse movements in particular as a result of the electrode head mass and primarily being provided for preventing breakages of the quartz glass cylinder 8.

Moreover, the molybdenum and tungsten parts are connected and joined in the region of the electrode rod holding arrangement without any high-temperature steps and are therefore much more ductile, i.e. less susceptible to faults, than conventional lamps.

The invention claimed is:

1. A high-pressure discharge lamp with an electrode rod (1), which is held in a glass vessel stem (4), characterized by a metal tube portion (5), in which an electrode rod part is held and which is held in the glass vessel stem (4), the metal tube portion (5) being fixedly connected to a metallic transverse support (6), which protrudes beyond the metal tube portion (5) transversely with respect to the direction of the electrode rod (1).

2. The lamp as claimed in claim 1, in which the electrode rod (1) is inserted axially into the tube portion (5) and in the process is cold-compressed with the tube portion (5).

3. The lamp as claimed in claim 2, in which a metal foil is interposed between the electrode rod (1) and the tube portion (5).

4. The lamp as claimed in claim 1, in which the tube portion (5) is surrounded by glass (8), and a metal foil (7) is interposed between the tube portion (5) and the glass (8).

5. The lamp as claimed in claim 1, in which the electrode rod (1) is tapered outside the metal tube portion at a point (10) which, when viewed in its axial direction, is less removed from the metal tube portion (5) than from the discharge-side electrode end (2).

6. The lamp as claimed in claim 1, in which the transverse support is a metal plate (6), which is fixedly connected to that end of the tube portion (5) which is remote from the discharge.

7. The lamp as claimed in claim 6, in which the plate (6) is terminated by a glass cylinder (8) around the tube portion (5) and is supported on a lamp bulb (3, 4) which surrounds the glass cylinder (8) and the plate (6).

8. The lamp as claimed in claim 6, in which the plate (6) is connected to a metal foil, which forms a power supply line to the plate (6) and via said plate to the electrode rod (1).

9. The lamp as claimed in claim 1, in which the electrode rod (1) is thicker at the end (2) remote from the discharge.

10. The lamp as claimed in claim 1, in which the electrode rod (1), the tube portion (5) and possibly the plate (6) are made from at least one element selected from the group consisting of molybdenum and tungsten, and possibly the metal foil (7) between the tube portion (5) and the glass (8) and possibly the metal foil in the form of a power supply line to the plate (6) are made from molybdenum, and finally, possibly the metal foil between the electrode rod (1) and the tube portion (5) is made from at least one element selected from the group consisting of tantalum, molybdenum and tungsten.

11. The lamp as claimed in claim 1, which is in the form of a mercury discharge lamp with an operating pressure of at least 5 bar.

12. The lamp as claimed in claim 1 with an electrical power of at least 1 kW.

13. A method for producing a high-pressure discharge lamp, in which an electrode rod (1) is fastened in a metal tube portion (5) and is thereby fastened in a glass vessel stem (4), the metal tube portion (5) being fixedly connected to a metallic transverse support (6), which protrudes beyond the metal tube portion (5) transversely with respect to the direction of the electrode rod (1).

14. The method as claimed in claim 13, in which the electrode rod (1) is pressed into the tube portion (5) axially under pressure and without any external heating and is thereby connected mechanically and electrically to said tube portion.

15. The method as claimed in claim 13, in which a metal foil is interposed between the electrode rod (1) and the tube portion (5).

16. The lamp as claimed in claim 7, in which the plate (6) is connected to a metal foil, which forms a power supply line to the plate (6) and via said plate to the electrode rod (1).

* * * * *